United States Patent [19]

Lindberg

[11] Patent Number: 5,050,540

[45] Date of Patent: Sep. 24, 1991

[54] METHOD OF GAS BLANKETING A BOILER

[76] Inventor: Arne Lindberg, 2902 Hawkshead, New Lenox, Ill. 60451

[21] Appl. No.: 647,260

[22] Filed: Jan. 29, 1991

[51] Int. Cl.[5] ..... B09B 3/00; F22B 1/00

[52] U.S. Cl. ..... 122/4 R; 55/39; 122/504

[58] Field of Search ..... 122/504, 406.1, 406.5, 122/4 R; 55/39, 26, 47

[56] References Cited

U.S. PATENT DOCUMENTS 3,050,040 8/1962 Stein ..... 122/4 R
3,210,912 10/1965 Peake et al. ..... 55/39
3,338,033 8/1967 Ross ..... 55/39
4,182,274 1/1980 Williams ..... 122/4 R

*Primary Examiner*—Edward G. Favors
*Attorney, Agent, or Firm*—Emrich & Dithmar

[57] ABSTRACT

A method of blanketing a boiler with nitrogen to reduce the level of oxygen dissolved in water in the boiler. The method includes the steps of creating a nitrogen blanket in the boiler, then preserving the nitrogen blanket during the subsequent filling of the boiler, and providing sufficient contact in the boiler between the water and the nitrogen to maximize the reduction of the level of oxygen dissolved in the water.

21 Claims, 3 Drawing Sheets

METHOD OF GAS BLANKETING A BOILER

BACKGROUND OF THE INVENTION

The present invention relates to a method of blanketing a boiler with nitrogen gas to reduce the level of dissolved oxygen in boiler water.

Internally initiated corrosion fatigue cracking of the tubes in many fossil fired boilers has become a major problem. The problem is aggravated in boilers which are frequently cycled on and off. The tube failures often result in costly forced boiler outages. In addition, internal corrosion fatigue failures are of particular concern because they can occur in the nonheat absorbing portion of the waterwall tubes. Failures can, therefore, pose a major safety concern by directing steam into high traffic areas of the plant.

Although the cause of internal corrosion fatigue cracking of boiler tubes has not yet been definitely determined, evidence strongly suggests that the level of dissolved oxygen in the boiler water plays an important role. Of particular concern is the dissolved oxygen level of the water which is used for filling the boiler and the water which is used for hydrostatic tests of the boiler.

Gas blankets have been used for years in several industries for off-line corrosion protection and as a means of preventing oxygen from redissolving in water after being removed by some other method. They have not, however, been used as a means for dissolved gas removal. Gas blankets have been used on storage tanks downstream of other deoxygenation devices, such as vacuum degasifiers and oxygen stripping columns, to preserve deoxygenated water. Nitrogen gas blankets have also been used on utility boilers but only in a method of downtime corrosion control, not deoxygenation. In fact, boiler manufacturer boiler fill and start-up recommendations make no attempt to preserve the nitrogen blanket.

Numerous water deoxygenation methods and devices are currently available. A standard device for removing dissolved oxygen from boiler water has been the vacuum degasifier which operates according to Henry's law to lower the partial pressure of oxygen by lowering the total pressure.

Another device is the oxygen stripping column which uses a stripping gas to remove oxygen from water. An oxygen stripping column is disadvantageous since it is a continuous flow process requiring the continuous supply of a stripping gas and, thus, is a relatively costly process.

Deaerators or D/C heaters have been used for years in the utility industry for the removal of dissolved oxygen from water. Steam bubblers are relatively new to the industry. Both the deaerator and the steam bubbler remove dissolved oxygen by scrubbing water with a continuous supply of steam. Oxygen removal with these devices is governed not only by Henry's Law but also by the heating of water above the desired dissolved oxygen saturation temperature. These devices suffer from the same cost disadvantage of an oxygen stripping column since it requires a continuous supply of steam.

Additionally, several methods have been devised in which an inert gas is sparged through water for dissolved gas removal. Some of these methods are more closely related to the oxygen stripping columns and, thus, are disadvantageous because they must rely on the continuous supply of a fresh stripping gas. In other gas sparging methods, the inert gas is recycled. All of the gas sparging methods rely on the circulation of an inert gas to provide the turbulence and surface contact area needed to enable the inert sparging gas to remove oxygen from water. Another disadvantage of these methods is the probability of gas binding in a boiler water circulation pump.

Although several of these methods and devices can effectively lower the dissolved oxygen level in water to less than 50 ppb, they can be quite expensive. For example, the capital investment alone for a 300 gpm to 500 gpm vacuum degasifier can range from $250,000 to $350,000 excluding installation.

Even after the investment is made in an effective make-up deoxygenation method or device, the boiler plant is still faced with the dilemma of transporting deoxygenated feedwater to the boiler without redissolving significant amounts of oxygen. It has been demonstrated that the dissolved oxygen levels of water used to fill an air-drained boiler essentially end up saturated at 7 ppm to 10 ppm (7000 ppb to 10000 ppb) regardless of the initial dissolved oxygen level. None of the above-identified methods and devices provide for the maintenance of deoxygenated feedwater supplied to the boiler.

SUMMARY OF THE INVENTION

The principal object of the present invention is to provide a method of effectively blanketing a boiler with nitrogen gas to reduce the level of dissolved oxygen in boiler water which avoids the disadvantages of prior art deoxygenation methods and devices. The disadvantages associated with oxygen stripping columns and aerator devices are obviated with the method of the present invention which allows the use of a batch rather than continuous supply of oxygen removing gas, thereby reducing the amount of gas required and, thus, the cost. The capital expense and engineering of a gas sparging system is obviated since the present invention provides for the movement of water, rather than a sparging gas, to increase the turbulence and the surface contact area necessary to enable the nitrogen gas to remove oxygen from the water. The present method additionally provides for the deoxygenation of feedwater supplied to the boiler.

Another object of the present invention is to provide a method of blanketing a boiler with a first gas adapted to reduce the level of a second gas dissolved in a liquid in the boiler, the boiler including a vent, the method comprising the steps of creating a gas blanket in the boiler, the gas blanket being comprised of the first gas, preserving the gas blanket in the boiler during the subsequent filling of the boiler with the liquid, and providing sufficient contact area in the boiler between the liquid and the first gas to allow the first gas to reduce the level of the dissolved second gas in the liquid.

Still another object of the present invention is to provide a method of blanketing a boiler unit with a gas adapted to reduce the level of oxygen dissolved in water in the boiler unit, the boiler unit comprising a water heater including a vent, a water heater storage tank connected to the water heater, and a boiler including a boiler drum having a vent, the boiler drum being connected to a superheater having a vent and to the water heater storage tank, the method comprising the steps of creating a gas blanket in the boiler and the water heater, the gas blanket being comprised of the gas, preserving the gas blanket in the boiler and the water heater during the subsequent filling of the boiler, the boiler being filled by filling the boiler drum, and providing sufficient contact in the boiler drum between the water and the gas during the filling of the boiler.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF PREFERRED EMBODIMENT

Figure 1:
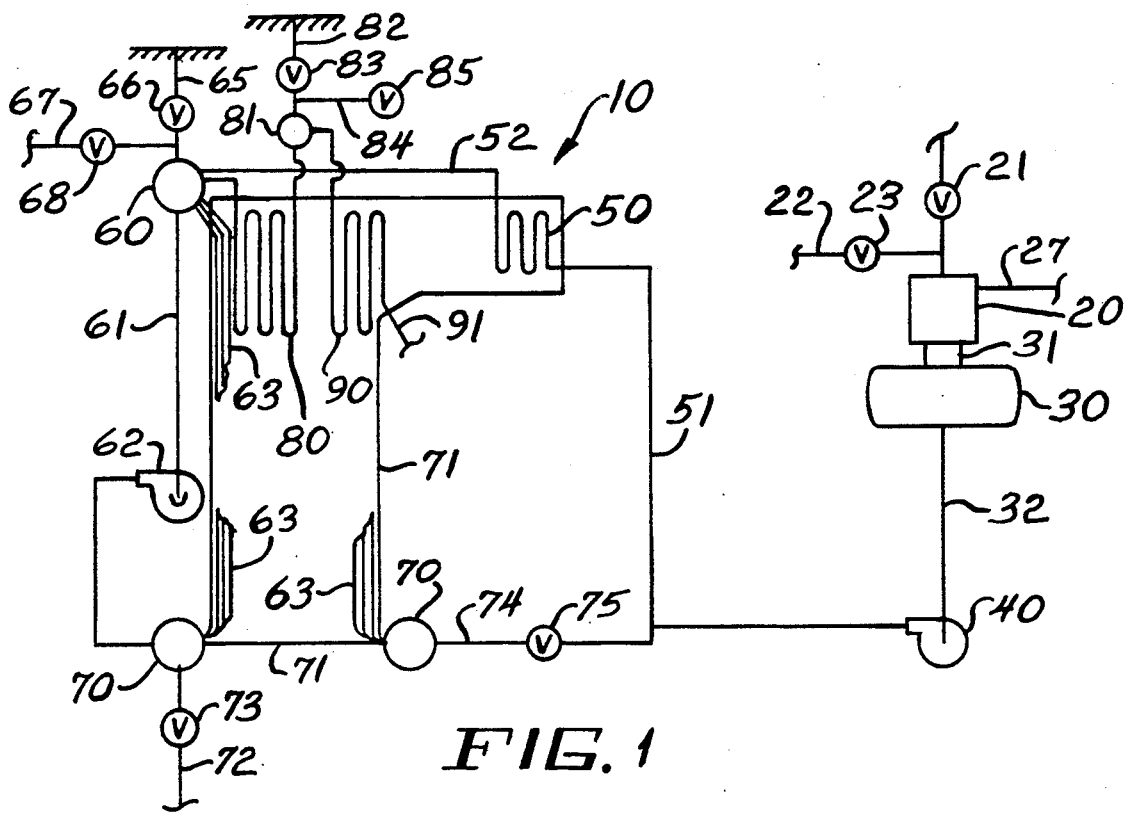
FIG. 1 is a schematic illustration of a controlled circulation boiler unit constructed in accordance with the features of the present invention.

FIG. 1 depicts a boiler unit including a controlled circulation boiler 10, a D/C water heater 20, and a D/C water storage tank 30.

Figure 3:
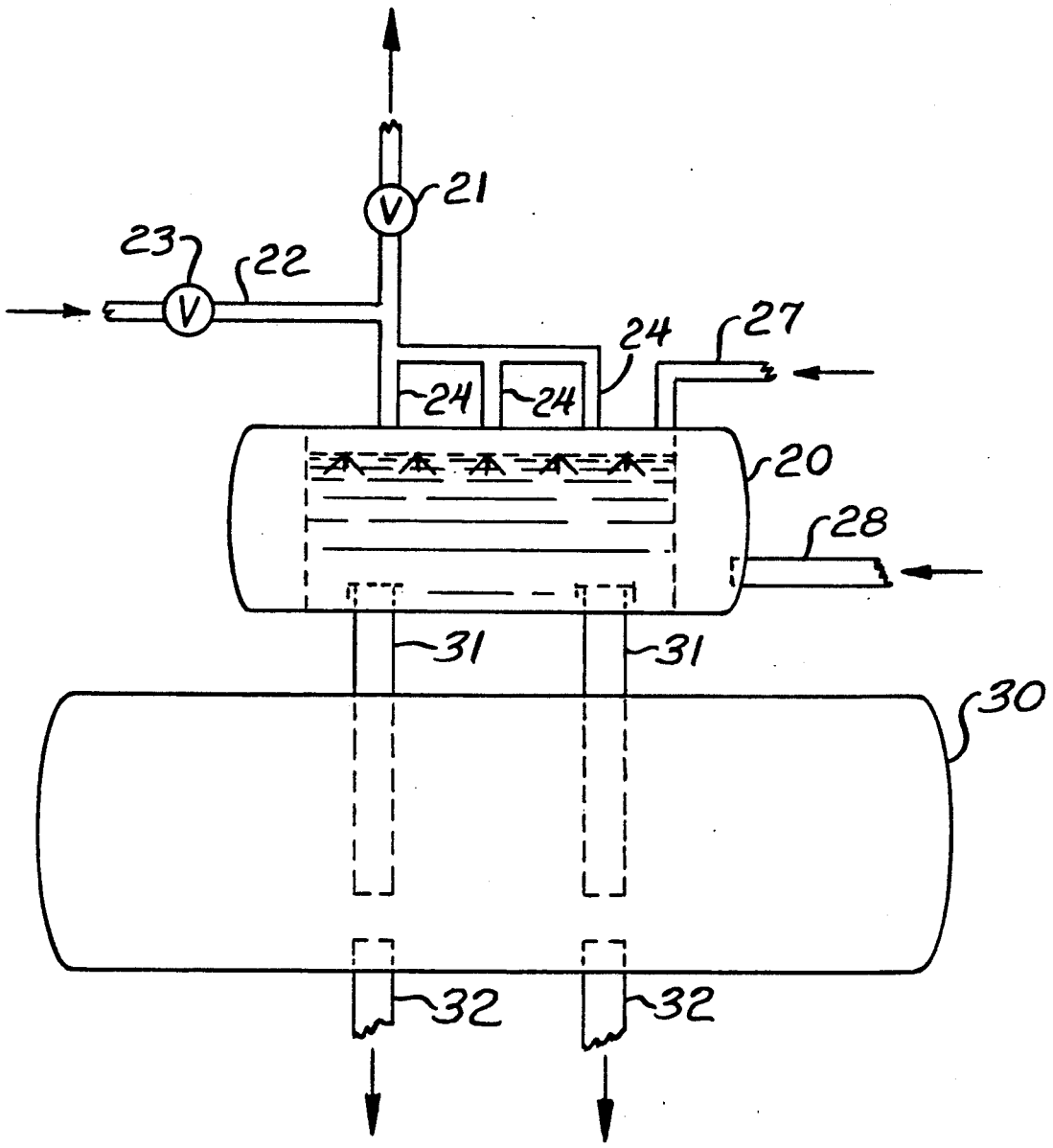
FIG. 3 is an enlarged view of the D/C water heater and storage tank shown in FIGS. 1 and 2, with inlet and outlet pipes and vents broken away.

Referring to FIG. 3, the D/C water heater 20 includes a vent 21, a nitrogen gas supply conduit 22 having a valve 23, conduits 24, a condensate water inlet conduit 27, and a steam supply conduit 28. The storage tank 30 is connected to the water heater 20 by conduits 31. The storage tank 30 includes conduits 32 connected to a boiler feed pump 40 (FIG. 1).

The boiler pump 40 is connected to an economizer 50 by a conduit 51. In turn, the economizer 50 is connected by a conduit 52 to an upper steam drum 60 connected to a pair of lower drums 70 by a tube 61 having a boiler water circulating pump 62 connected thereto and by a series of boiler tubes 63. The upper drum 60 includes a conduit 65 with a vent 66 and a nitrogen gas supply conduit 67 with a valve 68.

Additionally, the upper drum 60 is connected to a primary superheater 80 and a secondary superheater 90 which are interconnected by a superheater link header 81 having a link conduit 82 with a vent 83 and a nitrogen gas supply conduit 84 with a valve 85. The secondary superheater 90 is connected to a turbine (not shown) via a conduit 91.

The lower drums 70 are interconnected by conduits 71. One of the drums 70 is connected to a boiler drain 72 having a valve 73 while the other drum 70 is connected to the conduit 51 via a conduit 74 having an economizer recirculation valve 75.

In operation, water is heated in the heater 20 and then stored in the tank 30. During filling, the pump 40 feeds the water from the tank 30 into the boiler 10. The water is further heated in the economizer 50. From the economizer 50, the water flows into the upper drum 60 and the lower drums 70 through the tube 61 and the plurality of boiler tubes 63. Once the boiler 10 has been filled by filling the lower drums 70, the tube 61, the boiler tubes 63 and the upper drum 60, the boiler water circulating pump 62 is started. Then, the furnace is turned on and the water inside the boiler tubes 63 is heated and partly turned into steam. The pump 62 allows the water/steam mixture in the boiler tubes 63 to flow back into the upper drum 60. The steam in the upper drum 60 is then vented into the superheaters 80 and 90 and then the turbine. The water remaining in the drum 60 is recirculated back through the tube 61, lower drums 70 and then the tubes 63 to produce more steam.

Figure 2:
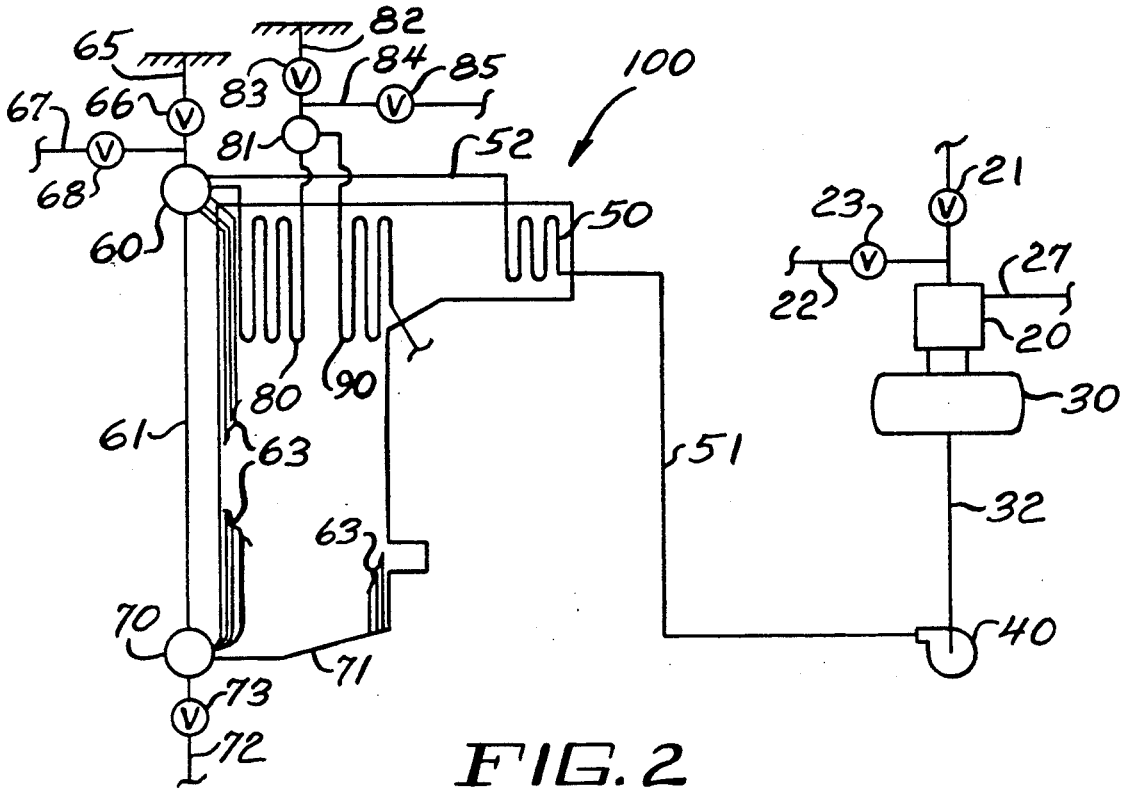
FIG. 2 is a schematic illustration of a natural circulation boiler unit constructed in accordance with the features of the present invention.

FIG. 2 depicts a boiler unit including a natural circulation boiler 100 which differs from the boiler 10 in that it does not include a boiler water circulating pump 62, a conduit 74 with a valve 75 and has only one lower drum 70. The operations of the boilers 10 and 100 are substantially identical except that, in the boiler 100, the water in the upper and lower drums is not continually forced recirculated by means of a circulation pump 62 but, rather is continually naturally recirculated by means of differences in water and steam densities.

In theory, the gas blanketing method of the present invention is governed by Henry's Law which states that the amount of a gas dissolved in water at equilibrium is directly proportional to the partial pressure of the gas above the liquid or—

Equation (1)

$$PO_2=(H)\times(X)$$

Where $PO_2$ = Partial pressure of oxygen

H = Henry's proportionality constant (at constant temperature) and

X = Mole fraction of dissolved oxygen (easily converted into unit of ppb)

The partial pressure of oxygen ($PO_2$) is the oxygen concentration in the atmosphere above the water times the total pressure (P) or—

Equation (2)

$$PO_2=(P)\times(\%\ O_2/100)$$

From Equation (2), it is evident that by lowering the percent $O_2$ with an effective nitrogen blanket, $PO_2$ can be decreased which, in turn, lowers the dissolved oxygen content of the water (X) via Equation (1).

From the above discussion, it is initially noted that the key to obtaining a low dissolved oxygen boiler fill is an effective gas blanket. The equations above hold true regardless of the blanketing gas used as long as it is essentially oxygen free. Nitrogen is used with the subject method because it is inexpensive and non-corrosive. Secondly, it is noted that the gas blanketing method will work when filling any oxygen purged vessel such as the boiler drums and/or the D/C heater if the method of filling the boiler drums and/or the D/C heater provides sufficient water-gas contact area so that the above equations are not kinetically limited. If sufficient water-gas contact is not provided by the boiler fill itself, turbulence should be provided to the liquid. Finally, the equations hold for the removal of any gas from any liquid. Of course, Henry's proportionality constant will be different and the fluid viscosity will have an effect of achieving adequate liquid-gas contact area.

The gas blanketing method of the present invention is basically a batch process in which a liquid is subjected to turbulence in a controlled gas blanketed environment to remove or reduce the level of an undesirable gas dissolved in the boiler water. The method has been proven quite effective using a nitrogen gas blanket for the removal of dissolved oxygen from the water in any vessel such as the D/C heater 20 or the boilers 10 and 100.

The method includes the three key steps of creating a nitrogen gas blanket in the D/C heater 20 and the boilers 10 and 100 prior to a boiler shut-down, preserving the nitrogen gas blanket in the D/C heater 20 and the boilers 10 and 100 during a shut-down and subsequent filling of the boilers 10 and 100 with water, and providing sufficient contact in the heater 20 and the boilers 10 and 100 between the water and the nitrogen gas during the filling of the boilers 10 and 100 to allow the nitrogen gas to remove or reduce the level of dissolved oxygen in the water and to prevent the process from being kinetically limited. If sufficient liquid-gas contact area is not provided by filling of the boilers 10 and 100, turbulence can be provided to the water in the atmosphere free of the oxygen.

With respect to the natural circulation boiler 100 (FIG. 2), the effective use of the gas blanketing method hinges on two parameters, i.e., gas blanket effectiveness in the heater 20 and the boiler 100.

A nitrogen gas blanket is created in the heater 20 by introducing the nitrogen into the heater 20 through the conduit 22 prior to a boiler shut-down. Then, the heater 20 is drained under the pressure of the nitrogen gas. Throughout the draining and subsequent boiler unit shut-down, the vent 21 should remain closed. A slight positive gas pressure of 2" Hg to 3" Hg should be kept on the heater 20 during the boiler shut-down. If any oxygen is allowed into the heater 20 prior to valving in the nitrogen, the heater 20 should first be completely filled (i.e., flooded) with water then drained under the pressure of the nitrogen gas. If flooding is not recommended from a structural standpoint, nitrogen should be introduced through the storage tank 30 and then through the conduit 22 to force an oxygen out of the heater 20 through the conduit 32.

By using the gas blanketing method on the heater 20, the feedwater in the heater 10 is preconditioned (i.e., deoxygenated) before entering the boiler 100. Preconditioning is important since it is the only way to deoxygenate the water remaining in the economizer 50 after a boiler fill. Further, it is important because near the end of a boiler fill, and particularly after the water level in the drum 60 rises above the feedwater inlet conduit 52, the nitrogen/water interface surface area is greatly diminished thereby adversely affecting the nitrogen blanket's ability to further deoxygenate the water in the boiler 100.

If the heater 20 cannot be effectively gas blanketed, preconditioning (i.e., deoxygenation) of the feedwater can be provided by some other deoxygenation source. However, to use another source, the heater 20 must be by-passed to prevent reaeration. Depending on the deoxygenated water source and the atmospheric conditions of a condenser (not shown) in the boiler unit, a hotwell (not shown) in the boiler unit might also need to be by-passed. Notwithstanding the dissolved oxygen level up stream of the boiler 100, the gas blanketing method is still required to prevent reaeration in the boiler 100.

Referring to FIG. 3, the heater 20 includes a sprinkler type system 24 which provides turbulence to the water as the heater 20 is being filled thereby providing and maximizing the contact area between the nitrogen and the water in the atmosphere above the water in the heater 20 and thus, maximizing the deoxygenation of the feedwater 20.

According to the method of the present invention, a nitrogen gas blanket is created in the boiler 100 by introducing nitrogen into the upper drum 60 through the conduit 67 subsequent to a boiler shut-down but prior to the pressure in the boiler 100 dropping to atmospheric pressure. Then, the boiler drain 72 is opened and the boiler 100 is drained under the pressure of the nitrogen gas. The boiler 100 is drained by draining the following elements: the upper drum 60, the tube 61, the tubes 63, the conduits 71 and 74 and the lower drums 70. The vent 66 should remain closed throughout the draining and subsequent boiler unit shut-down. A slight positive gas pressure of 2" Hg to 3" Hg should be kept on the boiler 100. The drain 72 is closed immediately following the boiler drain.

If any oxygen is allowed into the boiler 100 prior to valving in the nitrogen, the following oxygen purge methods should be used.

Under the first method, the boiler 100 and the superheaters 80 and 90 are completely filled (i.e., flooded) with water and then drained under the pressure of nitrogen gas as described above.

Under a second method, the oxygen may be purged without filling the superheaters 80 and 90. Under this method, the nitrogen supply valve 68 is initially closed and the boiler drum vent 66 is opened. Then, the boiler 100 is filled with water until the water level in the upper drum 60 is ten inches above normal firing level. After verifying that the superheater vent 83 is closed, nitrogen is introduced into the superheaters 80 and 90 through the conduit 84. After purging any oxygen in the primary superheater 80 into the boiler drum 60 and through the boiler drum vent 66 under the pressure of the nitrogen gas, the boiler drum 60 is filled to the top and the boiler drum vent 66 is subsequently closed. Finally, nitrogen is valved into the drum 60 and the boiler 100 is drained as described earlier.

After an effective nitrogen gas blanket has been created in the heater 20 and the boiler 100, it is preserved during boiler shut-down and, more importantly, during subsequent filling of the boiler 100 in a traditional manner with some changes.

Prior to filling the boiler 100, any high dissolved oxygen water remaining in the heater 20 is drained under the pressure of nitrogen gas as described earlier with the heater vent 21 closed. The heater vent 21 remains closed throughout the filling of the boiler 100. If needed, nitrogen pressure can be vented periodically but should not be allowed to drop below 5 psig. At the start of the filling, the drum vent 66 and the superheater link vent 83 are closed. As long as there is a positive nitrogen pressure on the boiler (i.e., greater than 2 Hg), the nitrogen supply valves 68 and 85 can be closed.

With the vents 66 and 83 closed, the pressure in the boiler 100 will increase as it is filled due to compression of the nitrogen gas. If the pressure in the boiler 100 reaches between approximately 5 and 10 psig, the superheater vent 83 can be opened to relieve the nitrogen gas pressure build-up. Pressure in the boiler 100 is maintained between 1 and 5 psig through the remainder of the fill. If the pressure in the boiler 100 reaches between approximately 10 psig and 15 psig, the vent 66 should be opened. Through the remainder of the fill, the pressure in the boiler 100 should then be maintained between 5 and 10 psig.

According to the invention, sufficient water-nitrogen contact to maximize deoxygenation is provided by the turbulence of the water as it free falls through the tube 61 and the boiler tubes 63 during filling of the boiler 100. Additionally, and although not shown in FIG. 2, the drum 60 is designed to provide turbulence to the water as it is introduced into the upper drum 60 thus providing additional water/nitrogen contact to further maximize deoxygenation.

The gas blanketing method is even more advantageous in the controlled circulation boiler 10 (FIG. 1) because water can be deoxygenated even after the boiler 10 has been filled.

In the boiler 10, preconditioning (i.e., deoxygenation) of the feedwater is not as crucial as in the natural circulation boiler 100 although it offers a couple of advantages. First, preconditioning lowers the final achievable boiler dissolved oxygen limit and, secondly, it allows the filling of the storage tank 30 with deoxygenated water. The method for preconditioning the feedwater in the heater 20 is the same as that described with respect to the boiler 100. A first method involves the creation of a nitrogen gas blanket in the heater 20 prior to boiler shut-down and the preservation of the gas blanket therein during the filling of the heater 20 in the same manner as described with respect to the natural circulation boiler 100. A second method is to provide an alternative deoxygenated feedwater source as previously described.

A nitrogen gas blanket is created and preserved in the boiler 10 in a manner identical to that described with respect to the boiler 100. If a nitrogen gas blanket is not created in the boiler 10, the boiler 10 is filled in the traditional manner.

As with the boiler 100, the turbulence of the water, resulting from its free fall through the tube 61 and the boiler tubes 63, provides the water/nitrogen contact area to maximize water deoxygenation.

After the boiler 10 is filled in the same manner as described with respect to the boiler 100, any oxygen in the atmosphere above the water in the drum 60 is purged.

The oxygen is purged in one of two ways. Initially, it is purged by opening the drum vent 66 and then completely filling the boiler 10 and superheaters 80 and 90 to remove all gases. Then, the drum vent 66 is closed, the nitrogen is introduced through the conduit 67, and the boiler 10 is drained back under nitrogen pressure such that the level of water in the drum 60 is approximately 10 to 15 inches above normal firing level.

Alternatively, the oxygen may be purged without filling the superheaters 80 and 90 in the following manner. Initially, the nitrogen supply valve 68 is closed and the boiler drum vent 66 is opened. Next, the boiler 10 is filled such that the level of water in the boiler drum 60 is approximately 10 inches above normal firing level. Thereafter, the superheater vent 83 is closed and the nitrogen supply valve 85 is opened. After purging for about 5 minutes any oxygen in the primary superheater 80 into the drum 60 and through the vent 66 under the pressure of the nitrogen gas, the drum 60 is filled to the top. Then, the vent 66 is closed and the valve 68 is opened to allow entry of nitrogen gas. Finally, the boiler 10 is drained back such that the level of water in the drum 60 is 10 to 15 inches above firing level.

After the oxygen has been purged from the boiler 10, the circulation pump 62 is started to cause the water to circulate from the upper drum 60, through the tube 61, the lower drums 70, the tubes 63, and back into the upper drum 60.

If the nitrogen supply flow rate in the boiler 10 is restricted, a 4 psig to 5 psig nitrogen pressure should be applied to the drum 60 prior to starting the pump 62 to prevent air from being drawn in from the sudden drop in the level of water in the boiler 10. If desired, the water level in the drum 60 can be raised and an additional pump(s) 62 started to speed up the process. Once the desired number of pumps 62 have been started, the water level should be maintained near normal firing level. The economizer recirculation valve 75 can be opened to help deoxygenate the water in the economizer 50.

Although not shown in FIG. 1, the drum 60 of the boiler 10 is also designed to provide turbulence to the water as the drum 60 is being filled and, additionally, as the water is being recirculated. Thus, in the controlled circulation boiler 10, sufficient contact area to maximize deoxygenation is provided not only during the fill as in the natural circulation boiler 100, but also during recirculation of the water through the drum 60.

The gas blanketing method of the present invention was tested in a natural circulation boiler 100 (FIG. 2) following the procedures previously described. Initially, tests were run to test the effectiveness of the gas blanketing method on the heater 20 and the tank 30. Because of repairs needed to the heater 20 prior to the testing, air was allowed into both the heater 20 and tank 30. The gas purge method previously described, wherein nitrogen is introduced through the conduit 22 to force any oxygen out of the heater 20 through the storage tank 30 and through the conduit 32, was chosen to remove as much oxygen as practical from the heater 20. Thereafter, the heater 20 was filled using the filling method previously described. The results of three such fills are shown in Table 1 below.

TABLE 1

D/C Heater Fill Test Data

| Run # | Inlet D.O. (ppb) | Heater % $O_2$ | Outlet D.O. (ppb) |
|---|---|---|---|
| 1 | 8500 | 7.0 | 4900 |
| 2 | 8500 | 6.8 | 4100 |
| 3 | 8500 | 3.6 | 2600 |

The outlet dissolved oxygen levels achieved were actually below saturation conditions according to Henry's Law. The difference was most likely due to sampling error caused by measuring the percent $O_2$ at the storage tank 30 when most of the turbulence is provided by design in the heater 20. Because the nitrogen is supplied to the heater 20, the heater 20 would have a slightly lower percent $O_2$. As shown in Table 1, the lowest percent $O_2$ achieved was 3.6% representing a 70% reduction in the dissolved oxygen level of the water fed into the heater 20.

Figure 4:
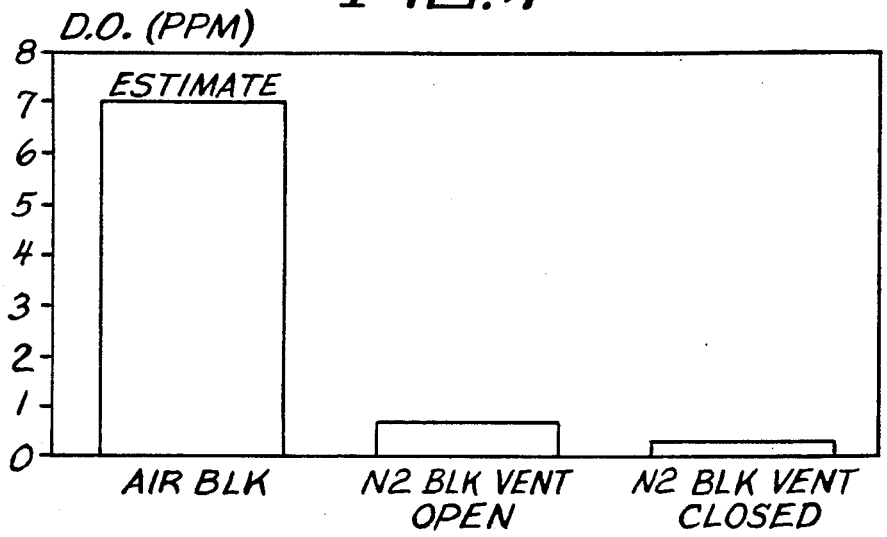
FIG. 4 is a chart depicting dissolved oxygen levels obtained during testing from: 1) filling an air blanketed boiler, 2) filling a nitrogen blanketed boiler, and 3) filling a boiler using the gas blanketing method of the present invention.

In addition, tests were conducted to ascertain the effectiveness of the gas blanketing method on the boiler 100 (FIG. 2) itself. FIG. 4 compares the results obtained from 1) filling an air blanketed boiler, 2) simply filling a nitrogen blanketed boiler, and 3) using the gas blanketing method. The results of the first test are based on estimated saturated dissolved oxygen levels using Henry's Law while the latter two are based on actual tests. Referring to FIG. 4, nitrogen blanketing provides a substantial improvement over simply filling an air blanketed boiler and using the gas blanketing method provides even further improvement. Even better dissolved oxygen levels can be obtained with better preconditioning of the water in the heater 20.

Figure 5:
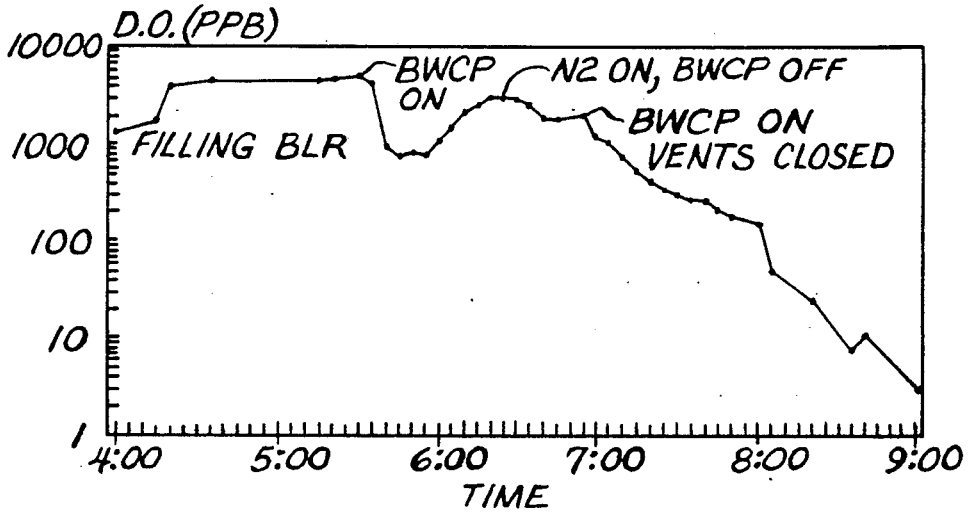
FIG. 5 is a graph, on a log scale, depicting the level of dissolved oxygen in water obtained during a test of the gas blanketing method of the present invention in a controlled circulation boiler.
Figure 6:
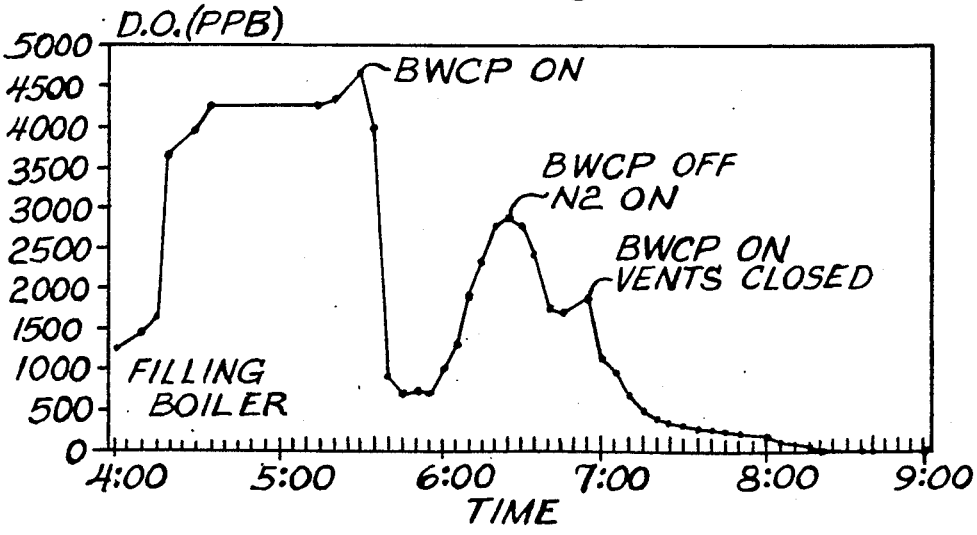
FIG. 6 is the graph of FIG. 5 on a linear scale.

Tests were also run to determine the effectiveness of the gas blanketing method in a controlled circulation boiler 10 (FIG. 1) following the procedures previously described. The results are shown in FIGS. 5 and 6. Immediately prior to the test, the boiler 100 was drained under nitrogen pressure. Thereafter, it was filled using the gas blanketing method previously described and then the boiler water circulation pump 62 was turned on. As shown in FIGS. 5 and 6, there was a dip and a subsequent rise in the level of dissolved oxygen in the water immediately after turning on the pump 62. The bottom of the dip, at a water dissolved oxygen level of approximately 700 ppb, represents the water dissolved oxygen level from filling a nitrogen blanketed boiler. The results are very similar to the results shown in FIG. 3 for the natural circulation boiler test. The subsequent rise in water dissolved oxygen level results from air being drawn into the drum 60 when the pump 62 is started and the gas blanketing method is not used.

Next, the pump 62 was shut off and oxygen in the atmosphere of the boiler drum 60 above the water level was removed using the oxygen purge method previously described. Thereafter, the vent 66 was closed and the pump 62 was once again turned on. As a result, the water dissolved oxygen level was reduced from approximately 3000 ppb to less than 10 ppb. The water dissolved oxygen levels below 50 ppb were independently verified using the Indigo Carmine Method.

While there has been described what at present is considered to be the preferred method of the present invention, it will be apparent to those skilled in the art that various modifications and alterations may be made herein without departing from the true spirit and scope of the invention. It is intended that all such variations and modifications are to be covered in the claims appended hereto.

I claim:

1. A method of blanketing a boiler with a first gas adapted to reduce the level of a second gas dissolved in a liquid in the boiler, the boiler including a vent, said method comprising the steps of:

a. creating a gas blanket in the boiler, said gas blanket being comprised of said first gas;
b. preserving said gas blanket in the boiler during the subsequent filling of the boiler with the liquid; and
c. providing sufficient contact in the boiler between the liquid and the first gas to allow said first gas to reduce the level of said dissolved second gas in the liquid.

2. The method of claim 1, wherein the gas blanket is created by:

a. introducing said first gas into the boiler subsequent to a boiler shut-down;
b. draining the liquid in the boiler under the pressure of said first gas; and
c. keeping the boiler vent closed during draining of the boiler.

3. The method of claim 2, further comprising the step of completely filling the boiler with the liquid prior to introducing said first gas and draining the boiler, said filling step being completed only if said second gas is present in the boiler prior to introducing said first gas.

4. The method of claim 2, wherein the boiler is connected to a superheater having a vent, said method further comprising the step of completely filling the boiler and the superheater prior to introducing said first gas into the boiler, said filling step being completed only if said second gas is present in the boiler prior to introducing said first gas.

5. The method of claim 2, wherein the boiler is connected to a superheater having a vent, said method further comprising the following steps prior to introducing said first gas into the boiler if said second gas is present in the boiler prior to introducing said first gas:

a. closing a first gas supply source connected to the boiler;
b. opening the boiler vent;
c. filling the boiler with the liquid to a level approximately ten inches above normal firing level;
d. closing the superheater vent;
e. introducing said first gas into the superheater by opening a first gas supply source connected to the superheater;
f. purging any of said second gas in the superheater into the boiler and through the boiler vent, said purging being performed under the pressure of said first gas;
g. filling the boiler to the top;
h. closing the boiler vent; and
i. introducing said first gas into the boiler by opening said first gas supply source connected thereto.

6. The method of claim 1, wherein the boiler is connected to a superheater having a vent, said gas blanket in the boiler being preserved during filling of the boiler by:

a. verifying that the boiler vent and the superheater vent are closed at the start of the filling;
b. opening the superheater vent during the filling of the boiler after the pressure in the boiler reaches between approximately 5 and 10 psig; and
c. maintaining the pressure in the boiler between approximately 1 and 5 psig during the remainder of the filling.

7. The method of claim 1, wherein the boiler is connected to a superheater having a vent, said gas blanket in the boiler being preserved during filling of the boiler by:

a. verifying that the boiler vent and the superheater vent are closed at the start of the filling;
b. opening the boiler vent during the filling of the boiler after the pressure in the boiler reaches approximately 10 and 15 psig; and
c. maintaining the pressure in the boiler between approximately 5 and 10 psig throughout the remainder of the filling.

8. The method of claim 1, further comprising the steps of purging any of said second gas present in said boiler above the liquid after the boiler has been filled, and circulating the liquid through the boiler.

9. The method of claim 8, wherein the boiler is connected to a superheater having a vent, said second gas being purged by:

a. closing a first gas supply source connected to the boiler;
b. opening the boiler vent;
c. filling the boiler to a level approximately ten inches above normal firing level;
d. closing the superheater vent;
e. introducing said first gas into the superheater by opening a first gas supply source connected to the superheater;
f. purging any of said second gas in the superheater into the boiler and through the boiler vent, said purging being performed under the pressure of said first gas;
g. filling the boiler to the top;
h. closing the boiler vent;
i. introducing said first gas into the boiler drum by opening the first gas supply source connected thereto; and
j. draining the boiler back to a level approximately ten to fifteen inches above normal firing level.

10. A method of blanketing a boiler unit with a gas adapted to reduce the level of oxygen dissolved in water in the boiler unit, the boiler unit comprising a water heater including a vent, a water heater storage tank connected to the water heater, and a boiler including a boiler drum having a vent, the boiler drum being connected to a superheater having a vent and to the water heater storage tank, said method comprising the steps of:

a. creating a gas blanket in the boiler and the water heater, said gas blanket being comprised of said gas;
b. preserving said gas blanket in the boiler and the water heater during the subsequent filling of the boiler, said boiler being filled by filling the boiler drum; and
c. providing sufficient contact in the boiler drum between the water and said gas during the filling of the boiler.

11. The method of claim 10, wherein the gas blanket is created by:

a. introducing said gas into the water heater and the boiler subsequent to a boiler shut-down;
b. draining the water heater and the water storage tank and the boiler under the pressure of said gas; and
c. keeping the water heater vent and the boiler drum vent closed during draining of said water heater and said boiler.

12. The method of claim 11, further comprising the step of completely filling the water heater and the water storage tank with water prior to introducing said gas into the water heater, said filling step being completed only if oxygen is present in the water heater prior to introducing said gas.

13. The method of claim 11, further comprising the step of completely filling the boiler drum and the superheater with water prior to introducing said gas into the boiler, said filling step being completed only if any oxygen is present in the boiler prior to introducing said gas.

14. The method of claim 11, further comprising the following steps prior to introducing said gas into the boiler if any oxygen is present in the boiler prior to introducing said gas:

a. closing a gas supply source connected to the boiler drum;
b. opening the boiler drum vent;
c. filling the boiler with water to a boiler drum water level approximately ten inches above normal firing level;
d. closing the superheater vent;
e. introducing said gas into the superheater by opening a gas supply source connected to the superheater;
f. purging any oxygen in the superheater into the boiler drum and through the boiler drum vent, said purging being performed under the pressure of said gas;
g. filling the boiler drum to the top;
h. closing the boiler drum vent;
i. introducing said gas into the boiler drum by opening said gas supply source connected thereto.

15. The method of claim 10, wherein said gas blanket in the boiler and the water heater is preserved during filling of the boiler by:

a. draining any water remaining in the water heater prior to filling the boiler, said draining being performed under the pressure of said gas;
b. verifying that the boiler drum vent and the water heater vent and the superheater vent are closed at the start of the filling;
c. opening the superheater vent during the filling of the boiler after the pressure in the boiler reaches between approximately five and ten psig; and
d. maintaining a pressure in the boiler between approximately one and five psig during the remainder of the filling.

16. The method of claim 10, wherein said gas blanket in the boiler and the water heater is preserved during filling of the boiler by:

a. draining any water remaining in the water heater prior to filling the boiler, said draining being performed under the pressure of said gas;
b. verifying that the boiler drum vent and the water heater vent and the superheater vent are closed at the start of the filling;
c. opening the boiler drum vent during the filling of the boiler after the pressure of the boiler reaches between approximately ten and fifteen psig; and
d. maintaining a pressure in the boiler between approximately five and ten psig throughout the remainder of the filling.

17. The method of claim 10, further comprising the steps of purging any oxygen which may be present in the boiler drum after filling the boiler, and circulating the water through the boiler.

18. The method of claim 17, wherein the oxygen is purged by:

a. opening the boiler drum vent;
b. completely filling the boiler and the superheater with water to remove all gases;
c. closing the boiler drum vent;
d. introducing said gas into the boiler; and
e. draining the boiler back under the pressure of said first gas to a boiler drum water level approximately ten to fifteen inches above normal firing level.

19. The method of claim 17, wherein said oxygen is purged by:

a. closing a gas supply source connected to the boiler drum;
b. opening the boiler drum vent;

c. filling the boiler drum to a level approximately ten inches above normal firing level;

d. closing the superheater vent;

e. introducing said gas into the superheater by opening a gas supply source connected to the superheater;

f. purging any oxygen in the superheater into the boiler drum and through the boiler drum vent, said purging being performed under the pressure of said gas;

g. filling the boiler drum to the top;

h. closing the boiler drum vent;

i. introducing said gas into the boiler drum by opening the gas supply source connected thereto; and j. draining the boiler back to a boiler drum water level approximately ten to fifteen inches above normal firing level.

20. The method of claim 10, wherein said gas is nitrogen and the amount of oxygen dissolved in the water in the boiler is approximately 10 ppb.

21. The method of claim 10, wherein said gas is nitrogen and the amount of oxygen dissolved in the water in the heater is approximately 2600 ppb.

* * * * *